US006589600B1

(12) United States Patent
Hasz et al.

(10) Patent No.: US 6,589,600 B1
(45) Date of Patent: Jul. 8, 2003

(54) TURBINE ENGINE COMPONENT HAVING ENHANCED HEAT TRANSFER CHARACTERISTICS AND METHOD FOR FORMING SAME

(75) Inventors: Wayne Charles Hasz, Pownal, VT (US); Nesim Abuaf, Schenectady, NY (US); Robert Alan Johnson, Simpsonville, SC (US); Ching-Pang Lee, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/345,541

(22) Filed: Jun. 30, 1999

(51) Int. Cl.[7] ..... B05D 3/12; B05D 1/36

(52) U.S. Cl. ..... 427/264; 427/271; 427/404

(58) Field of Search ..... 415/115, 116, 415/173.1, 173.2, 173.5, 175, 176, 177, 178, 191, 200; 416/95, 96 R, 96 A, 97 R, 228, 229 A, 235, 236 R, 236 A, 241 R; 60/752, 753, 755, 756; 428/600, 687; 165/133, 904; 427/189, 202, 264, 271, 404

(56) References Cited

U.S. PATENT DOCUMENTS

| | | | | | |
|---|---|---|---|---|---|
| 2,220,420 | A | * | 11/1940 | Meyer | 415/235 |
| 2,648,519 | A | * | 8/1953 | Campini | 416/95 |
| 3,700,418 | A | * | 10/1972 | Mayeda | 416/97 R |
| 3,975,165 | A | * | 8/1976 | Elbert et al. | 29/182.2 |
| 4,003,716 | A | | 1/1977 | Steigelman | |
| 4,116,723 | A | | 9/1978 | Gell et al. | |
| 4,689,242 | A | | 8/1987 | Pike | |
| 4,749,594 | A | | 6/1988 | Malikowski et al. | |
| 4,762,462 | A | * | 8/1988 | Lardellier | 415/177 |
| 4,884,820 | A | * | 12/1989 | Jackson et al. | 415/173.5 |
| 4,938,991 | A | | 7/1990 | Bird | |
| 5,055,032 | A | * | 10/1991 | Altemark et al. | 60/753 |
| 5,096,375 | A | * | 3/1992 | Ciokailo | 415/173.2 |
| 5,210,944 | A | * | 5/1993 | Monson et al. | 29/889.2 |
| 5,304,032 | A | * | 4/1994 | Bosna et al. | 415/200 |
| 5,353,865 | A | | 10/1994 | Adiutori et al. | |
| 5,399,313 | A | | 3/1995 | Ross et al. | |
| 5,549,927 | A | | 8/1996 | Cottone et al. | |
| 5,577,555 | A | | 11/1996 | Hisajima et al. | |
| 5,590,711 | A | | 1/1997 | Ishida et al. | |
| 5,858,558 | A | * | 1/1999 | Zhao et al. | 428/680 |
| 5,951,892 | A | * | 9/1999 | Wolfla et al. | 219/121.69 |
| 6,098,397 | A | * | 8/2000 | Glezer et al. | 60/752 |
| 6,113,347 | A | * | 9/2000 | Forrester | 415/173.4 |
| 6,142,734 | A | * | 11/2000 | Lee | 416/97 R |
| 6,155,778 | A | * | 12/2000 | Lee et al. | 415/116 |

FOREIGN PATENT DOCUMENTS

| | | | | |
|---|---|---|---|---|
| JP | 54-108053 | A2 * | 8/1979 | 165/133 |
| JP | 55-28483 | A2 * | 2/1980 | 165/33 |
| JP | 59-113204 | A2 * | 6/1984 | 416/97 R |

OTHER PUBLICATIONS

"Pastes, Transfer Tapes, Preforms", Praxair product brochure (3 pages), no date.

"Drills & Cutters", prints from website www.dremel.com, 3/99 (2 pages).

"Effects of Turbulator Profile and Spacing on Heat Transfer and Friction in a Channel" by M.E. Taslim and S.D. Spring, Journal of Thermophysics and Heat Transfere, vol. 8, No. 3, Jul.–Sep. 1994, pp. 555–562.

* cited by examiner

*Primary Examiner*—Michael Barr
(74) *Attorney, Agent, or Firm*—Toan P. Vo; Noreen C. Johnson

(57) ABSTRACT

A turbine engine component is provided that has a surface that contains a plurality of depressions that are effective to increase the surface area of the component. The depressions are generally concave in contour and improve the heat transfer characteristics of the component. Methods for forming the turbine engine components are also disclosed.

15 Claims, 3 Drawing Sheets

TURBINE ENGINE COMPONENT HAVING ENHANCED HEAT TRANSFER CHARACTERISTICS AND METHOD FOR FORMING SAME

BACKGROUND OF THE INVENTION

The invention relates to components used in turbine engines. More particularly, the invention is directed to a turbine engine component that has a treated surface to enhance the heat transfer characteristics of the component, and methods forming such a component.

Various techniques have been devised to maintain the temperature of turbine engine components below critical levels. As an example, coolant air from the engine compressor is often directed through the component, along one or more component surfaces. Such flow is understood in the art as "backside air flow," where coolant air is directed at a surface of an engine component that is not directly exposed to high temperature gases from combustion. In combination with backside air flow, turbulation has been used to enhance heat transfer. Turbulation has generally taken the form of protuberances or "bumps" on selected sections of the surface of the component, which functions to increase the heat transfer with the use of a coolant medium that is passed along the surface. Turbulation is formed by one of several techniques, including wire spraying and casting.

While turbulation has been found to improve the heat transfer characteristics of the treated component, further heat transfer improvements are continually sought in the art.

SUMMARY OF THE INVENTION

According to one aspect of the invention, a turbine engine component is provided that has a surface that contains a plurality of depressions that are effective to increase the surface area of the component. The depressions are generally concave in contour.

Another aspect of the invention calls for a method for forming a turbine engine component, including the steps of providing a substrate; applying a layer on the substrate, which includes a matrix phase and a discrete particulate phase; and then removing the discrete particulate phase. By removal of the discrete particulate phase, a plurality of depressions are left behind in the matrix phase.

Still another aspect of the present invention calls for a method of forming a turbine engine component, including the steps of providing a mold having a plurality of protrusions along a surface portion thereof, the protrusions forming a textured surface; injecting a molten alloy into the mold; cooling the molten alloy to form a turbine engine component; and removing the mold. The turbine engine component following removal of the mold has a textured surface that is complementary to the textured surface of the mold.

DETAILED DESCRIPTION OF THE INVENTION

Figure 1:
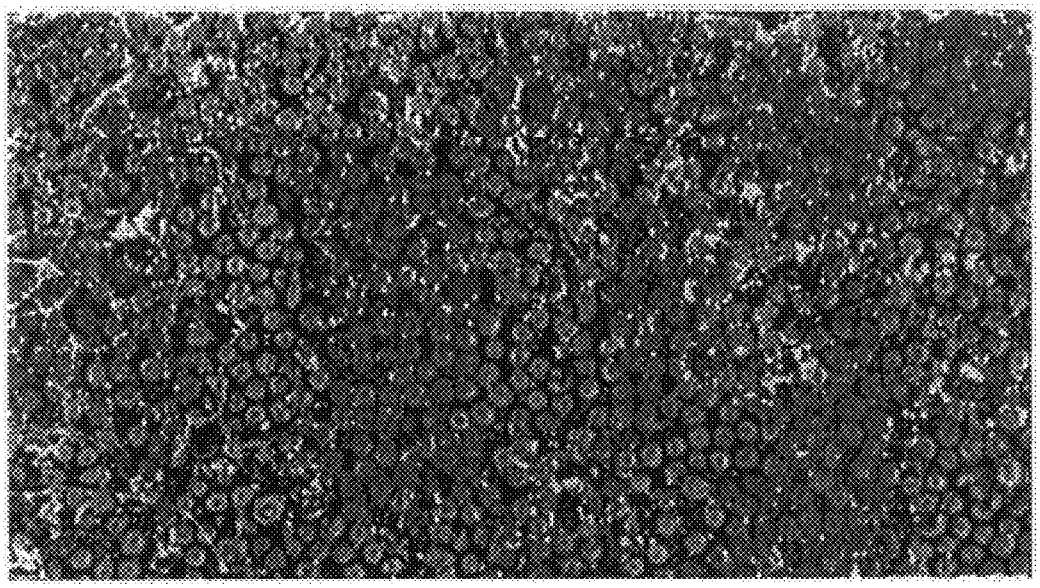
FIG. 1 is an SEM micrograph of a surface of a turbine engine component before an etch treatment.

Embodiments of the present invention utilize any material, including elemental metals, alloys, ceramics, composites, but generally take advantage of heat-resistant alloys designed for high-temperature environments, such as above 1000° C. As defined herein, "metal-based" refers to substrates that are primarily formed of metal or metal alloys. Some heat-resistant alloys are "superalloys" including cobalt-based, nickel-based, and iron-based alloys. In one embodiment, the superalloy is nickel- or cobalt-based, wherein nickel or cobalt is the single greatest element by weight. Illustrative nickel-based alloys include at least about 40 wt % nickel (Ni), and at least one component from the group consisting of cobalt, chromium, aluminum, tungsten, molybdenum, titanium, and iron. Examples of nickel-based superalloys are designated by the trade names Inconel®, Nimonic®, Rene® (e.g., Rene®80-, Rene®95 alloys), and Udimet®. Illustrative cobalt-based alloys include at least about 30 wt % cobalt (Co), and at least one component from the group consisting of nickel, chromium, aluminum, tungsten, molybdenum, titanium, and iron. Examples of cobalt-based superalloys are designated by the trade names Haynes®, Nozzaloy®, Stellite® and Ultimet®.

While the type of substrate can vary widely, it is often in the form of a turbine engine part formed of a superalloy, such as a combustor liner, combustor dome, bucket or blade, nozzle or vane, or airfoil. Other substrates are turbine parts that are not in the high-pressure stage of the turbine engine, such as in shroud clearance control areas, including flanges, casings, and rings. Such parts may not be formed of a superalloy in view of lower temperature environments to which the components are exposed. Typical alloys for such components include Inconel® 718, Inconel® 900 series, and Waspaloy®.

According to embodiments of the present invention, a surface of a substrate, particularly a turbine engine component, is treated or otherwise formed to include a plurality of depressions, each depression having a concave contour. The depressions are discrete, where individual depressions are separated from each other by interconnected ridges. For example, the treated surface of the component resembles "moon craters," described in more detail below. In the case of an airfoil, for example, the depressions forming a moon crater-like textured surface are provided along an interior surface which defines an inner cavity. Coolant air flow is provided along this interior surface, to provide backside cooling.

In one embodiment, treatment of the surface is carried out by use of an overlay coating. The overlay coating may be in the form of a free-standing sheet, such as in the case of a brazing sheet, as well as a slurry. The overlay coating contains a discrete, depression-producing phase and a matrix phase material such as a braze alloy.

In one embodiment of the invention, the brazing sheet is a green braze tape. Such tapes are commercially available. The green braze tape is formed from a slurry of a braze alloy, generally in the form of a braze alloy powder and binder in a liquid medium such as water or an organic liquid. The liquid medium may function as a solvent for the binder.

The composition of the braze alloy is generally nickel-based or cobalt-based. Nickel- or cobalt-based compositions generally denote compositions wherein nickel or cobalt is the single greatest element in the composition by weight percentage. The braze alloy composition may also contain silicon, boron, phosphorous or combinations thereof, which serve as melting point suppressants. It is noted that other types of braze alloys can be used, such as precious metal compositions containing silver, gold, or palladium, mixtures thereof, in combination with other metals, such as copper, manganese, nickel, chrome, silicon, and boron. Mixtures that include at least one of the braze alloy elements are also possible. Exemplary braze alloys have the following nominal compositions, by weight percent: 2.9 boron, 92.6 nickel, 4.5 tin; 3.0 boron, 7.0 chromium, 3.0 iron, 83.0 nickel, and 4.0 silicon; 19.0 chromium, 71.0 nickel, and 10.0 silicon; 1.8 boron, 94.7 nickel, and 3.5 silicon.

A variety of materials are generally used as binders in the slurry for forming the green braze tape. Non-limiting examples include water-based organic materials, such as polyethylene oxide and various acrylics. Solvent-based binders can also be used. Additional organic solvents (e.g., acetone, toluene, or various xylenes) or water may be added to the slurry to adjust viscosity.

The slurry is usually tape cast onto a removable support sheet, such as a plastic sheet formed of a material such as Mylar®. A doctor-blade apparatus is generally used for tape-casting. Substantially all of the volatile material in the slurry is then allowed to evaporate. The resulting braze alloy tape usually has a thickness in a range of about 1 micron to about 250 microns, and preferably, in a range of about 25 microns to about 125 microns.

Braze tapes containing the above-mentioned braze alloy and binder are commercially available. An example of a commercial product is the Amdry line of braze tapes, available from Sulzer Metco. An exemplary grade is Amdry®100.

The depression-producing phase that is applied to the green braze tape is typically a coarse powder, being formed of particles having a size sufficient to form defined ridges and depressions that function to increase heat transfer of the treated component. In many embodiments, the size of the particles is determined in large part by the desired degree of surface roughness and surface area (and consequently, heat transfer) that will be provided by the ridges and depressions. Surface roughness is characterized herein by the centerline average roughness value "Ra", as well as the average peak-to-valley distance "Rz" in a designated area as measured by optical profilometry. According to an embodiment, Ra is greater than about 0.1 mils, such as greater than about 1.0 mils, and preferably greater than about 2.0 mils. Ra is typically less than about 25 mils, more typically less than about 10 mils. Similarly, according to an embodiment, Rz is greater than about 1 mil, such as greater than about 5 mils. Rz is typically less than about 50 mils, more typically less than about 25 mils.

In one embodiment, the particles of the depression-producing powder are generally spherical, typically having an average aspect ratio of not greater than 2.0, desirably not greater than 1.5. In one embodiment the particles have an average aspect ratio not greater than about 1.2. The average size of the depression-producing powder particles is generally in the range of about 125 to about 4000 microns, such as about 150 to about 2050 microns. In a preferred embodiment, the average size of the powder particles is in the range of about 180 microns to about 600 microns.

The depression-producing material is formed of any material that may be selectively removed from the matrix phase material. Preferably, the particulate material does not react with the matrix material at elevated temperatures used for bonding the matrix material to the substrate. For example, the material may be metallic, such as nickel-chrome-aluminum-yttria alloys (NiCrAlY), which can be selectively removed from the braze alloy matrix by etching in an acid bath. Ceramic material may also be used, which may provide even more selectivity. For example, in one embodiment, alumina particles are utilized, which may be etched selectively from a braze alloy matrix with various oxidizing acids, such as hydrochloric acid. In low temperature applications, where the matrix phase is formed of a solder or high-temperature epoxy, plastics in particulate form can be used.

The powder can be randomly applied by a variety of techniques, such as sprinkling, pouring, blowing, roll-depositing, and the like. The choice of deposition technique will depend in part on the desired arrangement of powder particles, to provide the desired pattern of ridges and depressions. As an example, metered portions of the powder are sprinkled onto the tape surface through a sieve in those instances where the desired pattern-density of the depressions is relatively low.

Usually, an adhesive is applied to the surface of the green braze tape prior to the application of the depression-producing powder thereon. Any braze adhesive can be used, so long as it is capable of completely volatilizing during the subsequent fusing step. Illustrative examples of adhesives include polyethylene oxide and acrylic materials. Commercial examples of braze adhesives include "4B Braze Binder", available from Cotronics Corporation. The adhesive can be applied by various techniques. For example, liquid-like adhesives can be sprayed or coated onto the surface. A thin mat or film with double-sided adhesion could alternatively be used, such as 3M Company's 467 Adhesive Tape.

In one embodiment, prior to being brazed, the powder particles are shifted on the tape surface to provide the desired alignment that would be most suitable for heat transfer. For example, acicular particles having an elongated shape (e.g., aspect ratio greater than 2.0) may be physically aligned so that their longest dimension extends substantially perpendicular to the surface of the brazing sheet contacting the substrate. The alignment of the powder may be carried out by various other techniques as well. For example, physical, magnetic or electrostatic methods may be used to achieve the desired orientation. In yet another embodiment, individual particles or clusters of particles are coated with braze alloy, and such coated particles are placed on an adhesive sheet for application to a substrate. The adhesive sheet can be formed of any suitable adhesive, provided that it is substantially completely burned-out during the fusing operation. Suitable adhesives are discussed above.

In some embodiments, the depression-producing powder is patterned on the surface of the brazing sheet. Various techniques exist for patterning. In one embodiment, the braze alloy powder is applied to the substrate surface through a screen, by a screen printing technique. The screen has apertures of a pre-selected size and arrangement, depending on the desired shape and size of the protuberances. Alternatively, the braze adhesive is applied through the screen and onto the sheet. Removal of the screen results in a patterned adhesive layer. When the braze alloy powder is applied to the sheet, it will adhere to the areas that contain the adhesive. By use of a screen, a pattern may be defined having a plurality of "clusters" of particles, wherein the clusters are generally spaced apart from each other by a pitch corresponding to the spacing of the openings in the screen. The excess powder can easily be removed, leaving the desired pattern of particles. As another alternative, a "cookie cutter" technique may be employed, wherein the braze tape is first cut to define a desired depression-producing pattern, followed by removal of the excess braze tape. The depression-producing powder can then be applied to the patterned tape. In yet another embodiment, particles of the depression-producing material are coated with braze alloy, and the coated particles are adhered onto an adhesive sheet that volatilizes during the fusing step. Here, the adhesive sheet provides a simple means for attachment of the depression-producing material to the substrate prior to fusing, but generally plays no role in the final, fused article.

In another embodiment, the depression-producing powder is mixed with the other components of the green braze tape, such as braze alloy powder, binder and solvent, during formation of the green braze tape, rather than providing the depression-producing powder on a surface of the already formed tape. The depression-producing powder in turn forms a dispersed particulate phase within the green braze tape.

The removable support sheet, such as Mylar® backing is then detached from the green braze tape. The tape is then attached to a portion of the component-substrate where enhanced heat transfer is desired. As an example, an adhesive may be employed. Any adhesive suitable for attaching the tape to the substrate material would be suitable, provided that it completely volatilizes during the fusing step.

Another simple means of attachment is used in some embodiments. The green braze tape can be placed on a selected portion of the substrate, and then contacted with a solvent that partially dissolves and plasticizes the binder, causing the tape to conform and adhere to the substrate surface. As an example, toluene, acetone or another organic solvent could be sprayed or brushed onto the braze tape after the tape is placed on the substrate.

Following application of the green braze tape to the substrate, the tape is fused to the substrate. The fusing step can be carried out by various techniques, such as brazing and welding. Generally, fusing is carried out by brazing, which includes any method of joining metals with a filler metal or alloy without any substantial attendant melting of the base material of the substrate. Brazing temperatures depend in part on the type of braze alloy used, and are typically in the range of about 525° C. to about 1650° C. In the case of nickel-based braze alloys, braze temperatures are usually in the range of about 800° C. to about 1260° C.

When possible, brazing is often carried out in a vacuum furnace. The amount of vacuum will depend in part on the composition of the braze alloy. Usually, the vacuum will be in the range of about $10^{-1}$ torr to about $10^{-8}$ torr, achieved by evacuating ambient air from a vacuum chamber to the desired level.

In the case of a brazing sheet being applied to an area which does not lend itself to the use of a furnace, such as when the component itself is too large to be inserted into a furnace or in situ repair, a torch or other localized heating means is generally used. For example, a torch with an argon cover shield or flux is directed at the brazing surface. Specific, illustrative types of heating techniques for this purpose include the use of gas welding torches (e.g., oxy-acetylene, oxy-hydrogen, air-acetylene, air-hydrogen); RF (radio frequency) welding; TIG (tungsten inert-gas) welding; electron-beam welding; resistance welding; and the use of IR (infra-red) lamps.

The fusing step fuses the brazing sheet to the substrate. When the braze material cools, it forms a metallurgical bond at the surface of the substrate, with the depression-producing material mechanically retained by the solidified braze matrix material.

In another embodiment of the invention, the brazing sheet is in the form of a metal preform having first and second surfaces. The preform is formed of a metallic material similar to that of the substrate, such as a braze alloy like that described for the previous embodiment. Thus, if the substrate is a nickel-based superalloy, the preform material is generally a nickel-based superalloy. Other braze alloy compositions may also be suitable, such as those comprising cobalt or iron; or the precious metal compositions described previously. The braze alloy composition typically contains silicon, boron, or combinations thereof, which serve as melting point suppressants. However, unlike a green braze tape, the metal preform generally does not contain a binder since the preform is in densified form. The preform usually has a thickness of about 0.1 micron to about 2500 microns, and preferably, about 25 microns to about 200 microns.

Various techniques can be used to make the metal preform. In the first technique, a mixture of metallic powder material and binder is tape-cast onto a removable support sheet. The support sheet is removed, and the remaining green sheet is then sintered to form the preform, e.g., by using a vacuum heat treatment. The sintering temperature is dependent on various factors, such as the composition of the alloy of the preform, the size of the powder particles, and the desired density of the preform. This process is typically called a "tape-cast pre-form" technique.

According to another technique, a metallic powder material is deposited onto a support sheet as a thin layer of metal. Various thermal spray techniques are usually used for the deposition, such as vacuum plasma deposition, HVOF (high velocity oxy-fuel), or air plasma (AP) spray. Other deposition techniques could be employed as well, e.g., sputtering or physical vapor deposition (PVD). The support sheet is then removed, leaving the desired metal preform.

Yet another technique for making the preform is sometimes referred to as an amorphous metal ribbon technique. In this process, the metallic powder material is melted, and the molten material is poured onto a high-speed roller that very rapidly quenches the molten material. The quenched material is ejected from the roller as a ribbon. Braze preforms are commercially available from various sources, such as Wesgo and Allied Signal Company. In general, the braze preform differs from the green braze tape described above in that the preform is in a densified form (e.g., sintered) before application of the depression-producing powder and subsequent fusing to a substrate.

The depression-producing powder is applied to a surface of the braze preform. The powder generally has the same characteristics as the powder described for the previously described embodiment incorporating a green braze tape. Usually, an adhesive is applied to the surface of the preform, prior to the application of the depression-producing powder. The adhesive can be selected from those described previously, provided that it adheres to the metallic preform and it completely volatilizes during the subsequent fusing step. Illustrative adhesives are those that were described previously, e.g., polyethylene oxide and various acrylics. The braze alloy powder particles can also be shifted and aligned as described above, based on the required heat transfer characteristics for the substrate surface. Similarly, the powder particles can also be patterned on the surface of the preform by various techniques.

In some instances, the substrate surface to which the preform will be attached is curved. In such a case, it may be desirable to provide the preform with an identical curvature. Relatively thin preforms may be easily bent to match the curvature of a substrate. Preforms of greater thickness usually are not flexible, but can be shaped by other techniques. As an example, a removable support sheet is employed during fabrication, which sheet has the desired curvature of the substrate. The braze material is then deposited on the support sheet by the techniques described previously, e.g., thermal spraying or casting (for example, liquid metallic casting without a binder, or powder-slurry casting with a binder). The depression-producing powder can then be deposited on the preform, as also described previously. The preform which has the desired curvature can then be detached from the support sheet.

The braze preform is cut to a size appropriate for the site on the substrate where enhanced heat transfer is to be provided. The preform can then be attached to that portion of the substrate. As an example, the surface opposite that which is coated with the depression-producing powder is attached to the substrate with an adhesive sheet or adhesive composition. Any adhesive suitable for attaching the preform to the substrate metal should be suitable, as long as it completely volatilizes during the fusing step. Illustrative adhesives are those that were described previously.

Alternatively, the braze preform is attached by mechanical means. In some preferred embodiments, the preform is locally welded to the substrate surface at a few locations (spot welding). A variety of heating techniques could be employed, such as TIG (tungsten inert-gas) welding, resistance welding, gas welding (e.g., with a torch), RF welding, electron-beam welding, and IR lamp methods.

Fusing of the preform to the substrate can then be undertaken as described previously, with brazing often being used for this step. Brazing temperatures will again depend in part on the type of braze alloy used for the preform, and are typically in the range of about 525° C. to about 1650° C. In the case of nickel-based braze alloys as described above, braze temperatures are usually in the range of about 800° C. to about 1260° C. The fusing step fuses the preform to the substrate, as described previously, and may be carried out in a vacuum furnace. Alternatively, brazing may be accomplished through use of a torch or other heating technique (e.g., the welding techniques mentioned above) can be used for fusing the preform to the substrate, as an alternative to the vacuum furnace.

In an alternative embodiment, the preform comprises an alloy, pretextured by removal of a particulate phase to form depressions as described above, which preform is bonded to the substrate by a braze alloy layer. In this case, the preform is formed of an alloy having a higher melting or softening point than the braze alloy, and the preform is a free standing sheet already having the desired texture.

According to another embodiment, the substrate is coated with a layer of material in slurry form. That is, in contrast to the embodiments described above, a brazing sheet (in the form of a green braze tape or brazing preform) is not used. Rather, a slurry containing a liquid medium, braze alloy powder, and depression-producing powder is directly applied to a surface of the substrate. The slurry is dried, and then the coated substrate is heated such that the braze alloy softens to form a film that bonds the depression-producing powder to the substrate. The slurry typically contains a binder, and the liquid medium functions as a solvent for the binder. Use of a binder is desirable in cases where handling of the component is necessary after drying of the slurry and before fusing, such as transporting the coated component to a furnace.

The liquid medium may be water, an organic component such as acetone, toluene, or various xylenes, or mixtures of water and an organic component. The depression-producing powder, braze alloy powder, and binder may be formed of materials described above. By way of example, binders include water-based organic materials (or combinations of materials), such as polyethylene oxide and various acrylics. Non-aqueous solvent-based binders can also be used.

The slurry itself generally contains depression-producing powder, braze alloy, and binder. The amount of braze alloy is chosen relative to the depression-producing powder in an amount sufficient to bond the particles of the depression-producing powder to the substrate, such as about 1 to 40 wt % braze alloy and the balance (about 60 to 99 wt %) depression-producing powder. The amount of binder is generally present in an amount to ensure sufficient green strength for handling while minimizing the volume of binder burnout, such as about 1 to 20 wt % of the slurry.

Figure 2:
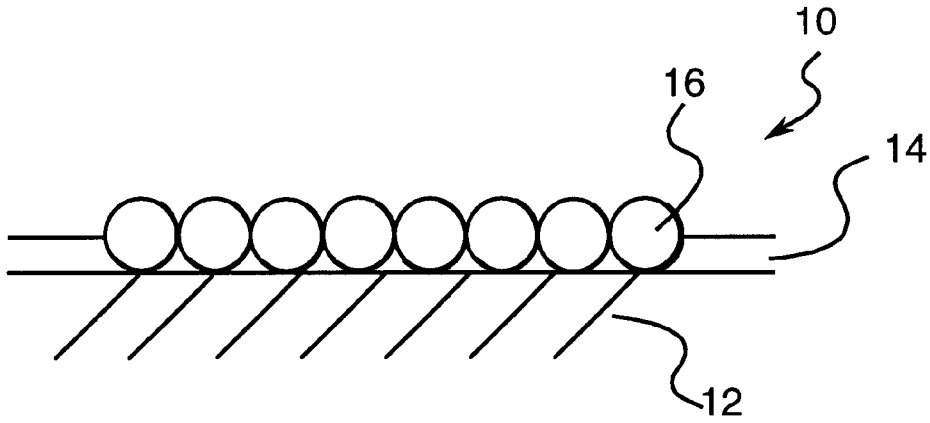
FIG. 2 illustrates a cross-section of a surface of a turbine engine component prior to etching.

In the embodiments described above, the structure of the component after-fusing includes a solidified braze alloy film that forms a portion of the outer surface of the component, and protuberances that extend beyond that surface. In reference to FIGS. 1 and 2, component 10 includes a substrate 12, matrix phase 14 in the form of a braze film, and particles 16 embedded in the matrix phase 14 to form protuberances. As shown, the particles 16 are generally arranged in a monolayer, which generally has little or no stacking of particles. Thus, after fusing, the treated component has an outer surface defined by the film of braze alloy, which has a particulate phase embedded therein. The film of braze alloy generally forms a continuous matrix phase. As used herein, "continuous" matrix phase denotes an interconnected film along the treated region of the substrate, between particles or clusters of particles. Alternatively, the film of braze alloy may not be continuous, but rather, be only locally present to bond individual particles to the substrate. In this case, the film of braze alloy is present in the form of localized fillets, surrounding discrete particles or clusters of particles. In either case, thin portions of the film may extend so as to coat or partially coat particles of the depression-producing powder.

Figure 3:
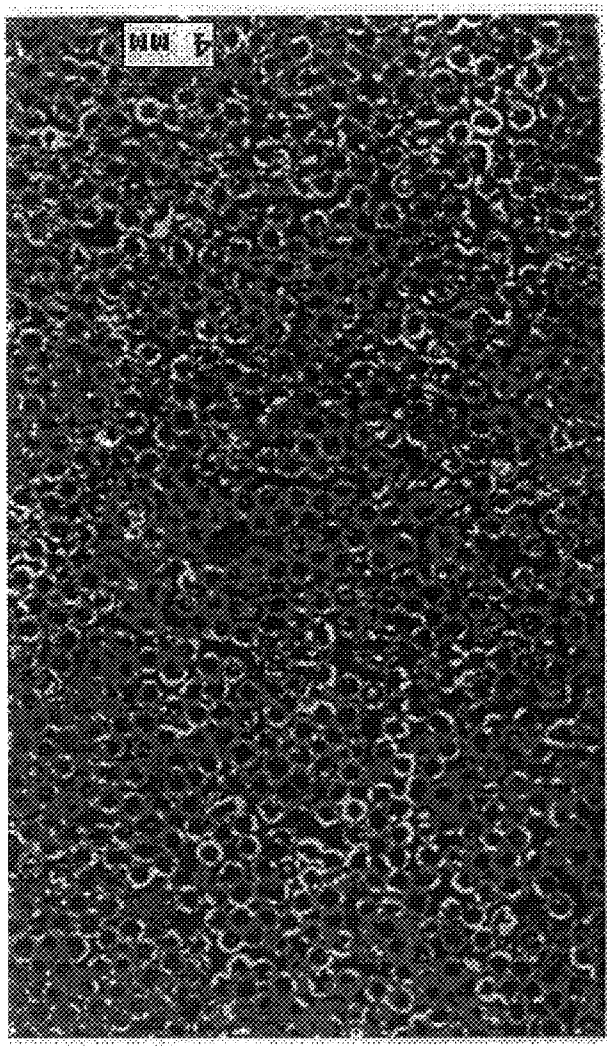
FIG. 3 is an SEM micrograph of the surface shown in FIG. 1 following an etch treatment.
Figure 4:
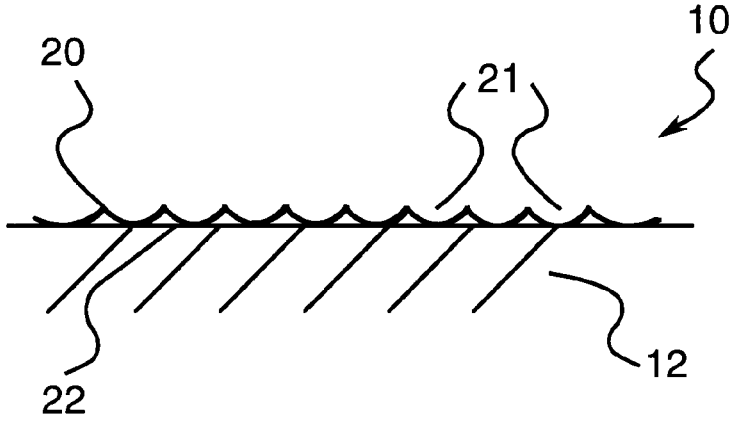
FIG. 4 illustrates a cross-section of the surface of FIG. 2 following etching.

Following fusing, the particulate phase is removed to leave behind the structure shown in the micrograph of FIG. 3, and illustrated in FIG. 4. As shown, the component now has a "moon-crater" like structure, defined by overlay coating 23 having ridges 20 that form an interconnected network, and discrete depressions 21. Typically, the overlay coating is formed of a single, homogeneous phase, as in the case of solidified braze alloy. In the example shown in FIG. 1, the particulates were formed of NiCrAlY, in a nickel-base braze alloy matrix (19 wt % Cr, 10 wt % Si, balance Ni). The particulates had a −50 to +80 mesh size, and were adhered to a green braze tape containing the above braze alloy. The tape was adhered to a substrate, and fused in place at a temperature of 2100° F. The particulates were removed by exposure of the particulates to a 1:1:1 bath of water, hydrochloric acid (HCl), and $HNO_3$ (nitric acid) for a duration of 3 hours at 70° C. As described above, other particulate/etchant systems can be utilized, provided that the particulates do not adversely react with the material of the matrix phase during fusing and that the particulates are removed selectively from the matrix. In cases where a thin film of the braze alloy covers the particulates, it is generally desirable to remove the layer such that the particles are directly exposed to the etchant. Such removal can be carried out by various means, including light grit blasting and brief exposure to an etchant to remove the film.

The depressions 21 have a concave contour, due to removal of generally spherical particles. It is expected that this contour shall be particularly effective at increasing the heat transfer of the treated component. The concave contour increases surface area with minimal added mass, which is important to reduce the heat conduction path length, the path length of phonons that propagate through the overlay coating 23. As used herein, the term "concave" as used in connection with the depressions according to embodiments of the present invention, means that in a cross-section extending through the bottom point of the depression, the depression is bounded by two line segments, each of which is concave as viewed from an exterior of the depression. Concavity of a depression according to an embodiment of the present invention is described in more detail below.

Figure 5:
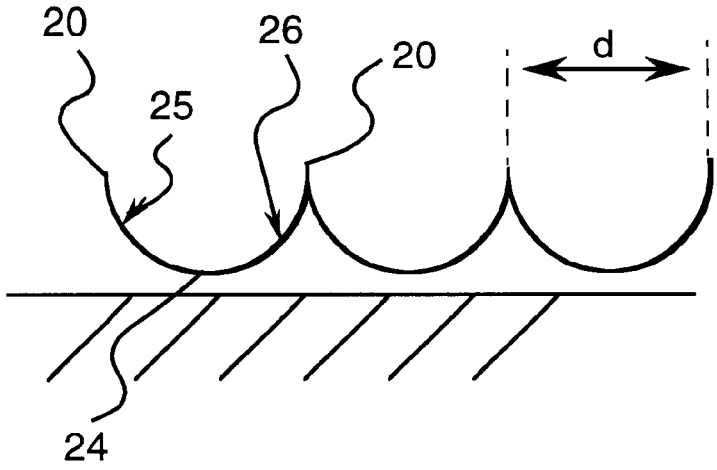
FIG. 5 illustrates an enlarged cross-sectional view of FIG. 4.

As shown in FIGS. 4 and 5, each depression has a bottom point 24, which is the bottom-most point of the depression. In the case of spherical particulates, the depressions 21 are generally hemispherical, and the bottom point 24 is located at the geometric center of the depression. In this regard, the cross-section of FIG. 5 is taken through the bottom point 24, and bisects the depression 21. In that cross-section, a first line segment 25 is defined, extending from a first side of ridge 20 to bottom point 24, and a second line segment 26, extending from a second side of ridge 20 to bottom point 24. As illustrated, each of the first and second line segments 25 and 26 is concave as viewed from an exterior of the depression 21, along a direction normal to the line segment. In this particular embodiment, the entirety of each line segment along its length is concave; each line segment has no convex portions.

As illustrated in FIG. 5, depression 21 has a diameter d. The diameter d generally corresponds to the size of the particulates of the depression-producing phase. Accordingly, the average diameter d is on the order of about 125 to about 4000 microns, such as about 125 to 2050 microns. Further, the depression 21 has a radius of curvature on the order of about 75 to about 2000 microns, such as about 75 to 1000 microns. The radius of curvature shown in the drawings is generally constant through the entirety of the depression due to the hemispherical contour of the depression. However, the radius of curvature need not be constant, such as is the case when non-spherical particles are used to form the depressions. Generally, non-hemispherical depressions have a radius of curvature at several points along the depression that fall within the values stated above.

Figure 6:
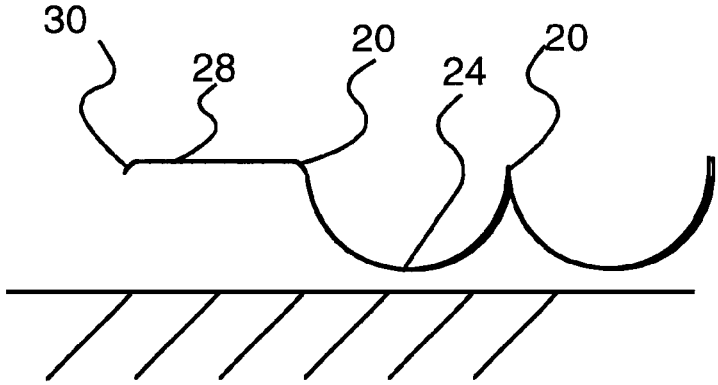
FIG. 6 illustrates another enlarged cross-sectional view of FIG. 4.

The ridge 20 shown in FIG. 5 forms a defined peak due to wetting action of the braze alloy along the outer surface of a particle of the depression-producing phase. However, the ridges need not be sharp, as shown in FIG. 6. Rounding of the ridge can be due to various factors, including a low degree of wetting of the matrix phase to the depression-producing phase during fusing, or erosion of the ridge by action of the etchant during the etch treatment. Also shown in FIG. 6 is a case where two particles of the depression-producing phase did not touch or closely pack together. Here, ridge 20, defining the rim of one depression, is separated from ridge 30 by a plateau 28. Such plateaus are generally present throughout the treated or textured surface, and form an interconnected network of ridges.

According to embodiments of the present invention described in particular detail above, a textured surface, having visible depressions, is formed in an overlay layer. By use of an overlay layer, the material of the layer may be chosen to enhance certain properties of the component. For example, the overlay layer may have desirable thermal conductivity, corrosion resistance, and oxidation resistance.

In an alterative embodiment, a turbine engine component having enhanced heat transfer is made directly during the casting operation, rather than by using the subtractive method described above, where a depression-producing phase is selectively removed from a matrix phase. In this alternative embodiment, molten alloy is injected into a mold which has an inner surface that is textured with bumps or protuberances. Accordingly, the base material of the component forms the texturing rather than an overlay coating. Suitable molten alloys include those mentioned above, such as cobalt- or nickel-based superalloys.

The protuberances typically have the same characteristics as the particulate phase described above with respect to the prior embodiment. In one form, the protuberances are generally spherical, having an average aspect ratio less than 2.0, typically less than about 1.5, and more particularly, not greater than about 1.2. The protuberances have an average height on the order 125 to about 4000 microns, such as about 125 to about 2050 microns. The mold may be manufactured by one of various techniques used in the art, such as what is, known as the "lost wax process." Typically, the mold is formed of a ceramic material to withstand the high temperatures generally associated with casting a molten alloy. Typical ceramic materials include alumina, silica, and combinations thereof.

Molds for casting typically have an outer shell and an inner core. In cases where the textured surface is along an interior of a part, such as an inner surface defining an internal cavity, an outer surface of the inner core is textured with the protuberances or bumps as described above. A typical example of such a component is a turbine blade which receives backside coolant flow.

Following casting, the alloy is allowed to cool and solidify. The mold is then separated from the component. Typically, a portion of the mold, such as the inner core, is destroyed in order to separate the mold from the cast component. The cast component has a textured surface that mimics or is complementary to the protuberance-containing surface of the mold. That is, the cast component has a plurality of recesses that are complementary to the protuberances of the mold. The geometrical characteristics of the textured surface, including contour, size, and shape of the recesses and ridges are as stated above for the embodiment formed using subtractive techniques.

According to the foregoing embodiments of the invention, the average depth of the depressions as measured from the ridge to the bottom point is on order of about 75 microns to about 2000 microns, particularly about 75 microns to about 1000 microns. In addition, according to embodiments of the present invention, the density of depressions generally is at least 25 depressions/$cm^2$, typically not less than 100 depressions/$cm^2$, and desirably not less than 500 depressions/$cm^2$. In one embodiment, the depression density was about 1100 depressions/$cm^2$, and another 3100 depressions/$cm^2$.

The texturing of the turbine engine components according to embodiments of the present invention is effective to increase surface area of the substrate. For example, area enhancement $A/A_0$, where A is the surface area of the treated region of the component and $A_0$ is the surface area of the same region of the component in untreated form (generally a smooth surface), is generally at least about 1.05, typically at least about 1.20. Area enhancement $A/A_0$ is desirably at least about 1.50. $A/A_0$ is generally less than about 4.0, typically less than about 2.5.

In most embodiments, the textured surface containing ridges and depressions or recesses is present to enhance the heat transfer characteristics for the underlying component.

The enhanced heat transfer characteristics in turn result in a desirable temperature reduction for specified regions of the component, leading to a desirable reduction in thermal stress. Moreover, by tailoring the size and spacing of the depressions, the heat transfer enhancement can also be adjusted, which in turn results in a reduction in the thermal and stress gradients for the component.

According to embodiments of the present invention, by reducing the profile of the textured surface over conventional cast turbulators, pressure drop of the coolant medium flow across the cooled surface is reduced and the fin cooling efficiency is improved. For example, in one embodiment, the depth of the depressions is not greater than 600 microns, more particularly, less than about 375 microns to improve fin efficiency.

Texturing can be applied to a wide variety of turbine engine components. For example, other superalloy components including combustor liners, combustor domes, buckets or blades, nozzles, vanes, airfoils, or shrouds. Non-superalloy components used in lower temperature applications may also be treated. For example, shroud clearance control areas, including flanges, casings, and rings may be advantageously treated. In these embodiments, use of texturing permits more accurate control of the diameter of the flowpath shroud, thereby decreasing the clearance between the blade tip and shroud surface and increasing efficiency. In view of the lower temperature requirements for the materials of such components, in the case of an overlay coating, the braze alloy may be replaced with another bonding agent such as a high temperature epoxy or solder, for example.

As described above, cooling is generally carried out by impingement cooling, that is, with a coolant medium that is directed perpendicularly against a component used in a high temperature environment. It should be understood that while impingement cooling represents a preferable form of cooling, the coolant medium can be directed at varying angles with respect to the textured surface. In addition, while the coolant medium is usually air, it could also be composed of other fluids such as water.

As described above, a textured surface is cast-in or provided in the form of an overlay coating to improve heat transfer. The increase in heat transfer is believed to be largely due to the increased surface area of the treated component. The textured surface may also increase heat transfer by modifying the coolant medium flow characteristics, such as from laminar flow to turbulated flow along the surface.

According to embodiments of the present invention, methods are provided that permit texturing of surfaces that are not easily accessible, to provide improved heat transfer. Further, embodiments of the present invention enable formation of a depression/ridge system of varying sizes and geometries, and in patterns, if desired. Because the textured surface on the turbine engine component has increased surface area and minimal material mass, heat transfer is further improved by reducing phonon path length through the component.

Having described preferred embodiments of the present invention, alternative embodiments may become apparent to those skilled in the art without departing from the spirit of this invention. Accordingly, it is understood that the scope of this invention is to be limited only by the appended claims.

What is claimed:

1. A method for forming a turbine engine component, the method comprising the steps of:

providing a substrate;

applying a layer on the substrate, said layer comprising a matrix phase and a discrete particulate phase; and removing selectively and completely at least the discrete particulate phase, leaving behind a plurality of depressions in the matrix phase.

2. The method of claim 1, further comprising a step of heating the substrate to fuse the discrete particulate phase to the substrate, prior the step of removing.

3. The method of claim 1, wherein the discrete particulate phase is removed by etching.

4. The method of claim 1, wherein the substrate comprises a superalloy.

5. The method of claim 1, wherein the substrate is a nickel-based superalloy, and includes at least one, component from the group consisting of cobalt, aluminum, silicon, chromium, tungsten, molybdenum, titanium, and iron.

6. The method of claim 1, wherein the turbine engine component is a component from the group consisting of a combustor liner, a combustor dome, a bucket or blade, a nozzle or vane, a shroud, an airfoil, and a shroud clearance control component.

7. The method of claim 1, wherein the matrix phase comprises a braze alloy.

8. The method of claim 7, wherein the braze alloy comprises a nickel-based or a cobalt-based alloy.

9. The method of claim 1, wherein the discrete particulate phase comprises particles that are generally spherical.

10. The method of claim 9, wherein the particles have an average aspect ratio less than 2.0.

11. The method of claim 10, wherein the particles have an average aspect ratio less than about 1.5.

12. The method of claim 11, wherein the particles have an average aspect ratio less than about 1.2.

13. The method of claim 9, wherein the particles have an average particle size within a range of about 125 microns to about 4000 microns.

14. The method of claim 13, wherein the particles have an average particle size of about 125 to about 2050 microns.

15. A method for forming a turbine engine component, the method comprising the steps of:

providing a substrate comprised of a nickel-based or cobalt-based superalloy;

applying a layer on the substrate, said layer comprising a matrix phase and a discrete particulate phase comprising particles having an aspect ratio of not greater than 1.5;

heating the substrate to fuse the discrete particulate phase to the substrate; and removing selectively and completely at least the discrete particulate phase, leaving behind a plurality of depressions in the matrix phase.

* * * * *

UNITED STATES PATENT AND TRADEMARK OFFICE

CERTIFICATE OF CORRECTION

PATENT NO. : 6,589,600 B1
DATED : July 8, 2003
INVENTOR(S) : Hasz et al.

It is certified that error appears in the above-identified patent and that said Letters Patent is hereby corrected as shown below:

Column 5,
Line 41, after 525º cancel "C." and substitute -- C --.
Line 43, after 800º cancel "C." and substitute -- C --.

Column 7,
Line 34, after 525º cancel "C." and substitute -- C --.
Line 36, after 800º cancel "C." and substitute -- C --.

Column 9,
Lines 30, 31 and 33, after diameter cancel "d" and substitute -- d --.

Signed and Sealed this

Eleventh Day of November, 2003

JAMES E. ROGAN
*Director of the United States Patent and Trademark Office*